US005551518A

United States Patent [19]

Stratton

[11] Patent Number: 5,551,518

[45] Date of Patent: Sep. 3, 1996

[54] TILT RATE COMPENSATION IMPLEMENT SYSTEM AND METHOD

[75] Inventor: Kenneth L. Stratton, Dunlap, Ill.

[73] Assignee: Caterpillar Inc., Peoria, Ill.

[21] Appl. No.: 314,473

[22] Filed: Dec. 19, 1994

[51] Int. Cl.[6] ..... E02F 3/76; E02F 3/85

[52] U.S. Cl. ..... 172/4.5; 364/424.07; 172/812; 37/382

[58] Field of Search ..... 172/4.5, 4, 812; 364/424.07; 37/414, 382

[56] References Cited

U.S. PATENT DOCUMENTS

| | | | |
|---|---|---|---|
| 3,831,683 | 8/1974 | Ikeda et al. | 172/4.5 |
| 4,157,118 | 6/1979 | Suganami et al. | 172/4.5 |
| 4,282,933 | 8/1981 | Suganami et al. | 172/4.5 |
| 4,516,469 | 5/1985 | Sato et al. | 91/362 |
| 4,802,537 | 2/1989 | Ryerson | 172/812 |
| 4,807,131 | 2/1989 | Clegg | 172/4.5 |
| 4,934,463 | 6/1990 | Ishida et al. | 172/4.5 |
| 5,174,385 | 12/1992 | Shonbo et al. | 172/4.5 |

*Primary Examiner*—Randolph A. Reese
*Assistant Examiner*—Spencer Warnick
*Attorney, Agent, or Firm*—Alan J. Hickman

[57] ABSTRACT

A tilt rate compensating implement system and method utilizes first hand second sensors for sensing the position of the rod end portion of first and second implement lift jacks. A controller calculates a tilt angle of the implement based on a difference in the amount of extension of the lift jacks. An inclinometer senses an angle of the frame relative to a predetermined plane and a tilt rate sensor senses the rate of change of the frame angle relative to said plane. A corrected frame angle based on signals from the inclinometer and tilt rate sensors is combined with the implement tilt angle to provide a corrected implement tilt angle. A display device displays the corrected implement tilt angle. The controller compares the corrected implement tilt angle to the desired implement tilt angle and actuates a fluid operated system to move a tilt jack in response to a difference between the desired and corrected implement tilt angles. The tilt angle control system is particularly suited for use on a bulldozer.

20 Claims, 6 Drawing Sheets

TILT RATE COMPENSATION IMPLEMENT SYSTEM AND METHOD

TECHNICAL FIELD

This invention relates to an implement system and more particularly to an implement control and monitoring system having tilt rate compensation and a method for monitoring and controlling the position of a geographic surface altering implement.

BACKGROUND ART

Systems for controlling the position of a geographic surface altering implement have been utilized for decades. For example, such control systems are used to move implements used on machinery such as bulldozers, motor graders, wheel loaders, compactors, pavers, asphalt layers, profilers, and the like. Typically, the control system enables a vehicle operator, depending upon the specific type of implement being controlled, to control lifting, tilting, and tipping of the implement by way of a fluid operated system. Because such systems are manually controlled (requires good hand-eye coordination) the accuracy and consistency of implement positioning will vary from operator to operator and from time to time. Since a substantial amount of trial and error is required by even the most skilled operator both efficiency and accuracy of operation will suffer.

To tilt an implement, for example the blade of a bulldozer, to an angle required to obtain the desired slope of cut is difficult for even the most skilled operator. This is based on the fact that the tilted angle of the blade is an operator observed position and not based on a fixed reference. It is particularly difficult to position and maintain the blade at a desired resultant angle under the dynamics of vehicle operation since any visual reference made to the terrain varies as the machine travels along the underlying surface. Thus, numerous additional passes of the dozing vehicle and frequent checks (surveys) of the worked surface are required.

Attempts have been made to automate positioning of geographic surface altering implements. An example of such an attempt is shown in U.S. Pat. No. 4,282,933, dated Aug. 11, 1981, to Takashi Suganami. This patent discloses, among other things, an automatic tilt control utilizing an inclinometer mounted on the dozer blade for sensing the tilt angle of the blade relative to the horizontal and a tilt angle setting device for selecting the desired tilt angle. The output from the inclinometer and the tilt angle setting device are compared and a corresponding signal is delivered to the tilt control system. This causes energization of a solenoid operated valve and tilting of the blade to the desired resultant angle. Tilting of the blade continues during operation to maintain the blade at the desired angle. Since inclinometers tend to be sensitive to motion and deliver erroneous signals when jostled about, the mounting of an inclinometer on a dozer blade, an implement that is constantly moved, vibrated, and subjected to the harshness of geographic surface altering operations is inappropriate.

Further, automatic control systems conceived for use on geographic surface altering machines have not proven satisfactory as they are inaccurate and tend to have a relatively short life caused by the harsh environment in which the geographic surface altering machine is operated.

Under the dynamics of vehicle operation, the tilt angle of the implement changes relative to the horizontal reference plane. This erratic movement affects the accuracy of the cut and fill operation and results in an irregular sloped surface.

The use of an inclinometer, a generally static sensing device, on the machine frame does not solve this problem as it is not capable of dealing with the rate of change of implement tilt angle position caused by machine dynamics. No solution has been provided heretofore which addresses and corrects the tilt angle error caused by machine dynamics.

The present invention is directed to overcoming one or more of the problems as set forth above.

DISCLOSURE OF THE INVENTION

A tilt angle system for a geographic surface altering implement has first and second lift jacks each having first and second end portions. The first end portions are connected to a frame and the second end portions are connected to an implement. The second end portions are extensibly movable relative to the first end portion in response to elevational movement of said implement. A first sensing means senses the position of the first end portion of the first lift jack relative to the second end portion of the first lift jack and delivers a responsive first position signal. A second sensing means senses the position of the first end portion of the second lift jack relative to the second end portion of the second lift jack and delivers a responsive second position signal. A third sensing means senses a frame tilt angle relative to a predetermined plane and delivers a responsive frame tilt angle signal. A forth sensing means senses a rate of change of the frame tilt angle relative to the predetermined plane and delivers a responsive rate of change signal. A control means receives the first, second, frame tilt angle, and rate of change signals, determines an implement tilt angle relative to the frame based on the first and second signals, determines a frame tilt angle based on the frame tilt angle signal, determines a corrected frame tilt angle based on the frame tilt angle and rate of change signals, combines the implement tilt angle and the corrected frame tilt angle and delivers a responsive corrected implement tilt angle signal.

A display receives a the tilt angle signal and indicates a corresponding tilt angle of the implement relative to the predetermined plane.

A command device facilitates selection of an automatic control mode of operation, a display mode of operation, and a desired implement tilt angle. The control means compares the corrected implement tilt angle to the desired implement tilt angle at the automatic control mode of operation and delivers an implement tilt control signal in response to said corrected implement tilt angle being greater or less than the desired implement tilt angle.

A fluid operated implement control system delivers pressurized fluid flow to a tilt jack in response to receiving the implement tilt control signal and moves the implement in a direction toward a desired implement tilt angle in response to receiving said pressurized fluid flow.

A method for determining a corrected tilt angle of an implement pivotally connected to a frame, and first and second spaced apart lift jacks connected to the frame. The method comprising the steps of sensing a position of a first end portion of the first lift jack relative toga second end portion of the first lift jack, sensing a position of a first end portion of the second lift jack relative to a second end portion of the second lift jack, sensing a tilt angle of the frame relative to a predetermined plane, sensing a rate of change of tilting of said frame relative to said predetermined plane, calculating an implement tilt angle based on the relative positions of the first and second end portions of the first and second lift jacks, calculating a corrected frame tilt angle based on the frame tilt angle and the rate of change of tilting of said frame, and calculating a corrected implement tilt angle based on the implement tilt angle and the corrected frame tilt angle.

BEST MOST FOR CARRYING OUT THE INVENTION

Figure 1:
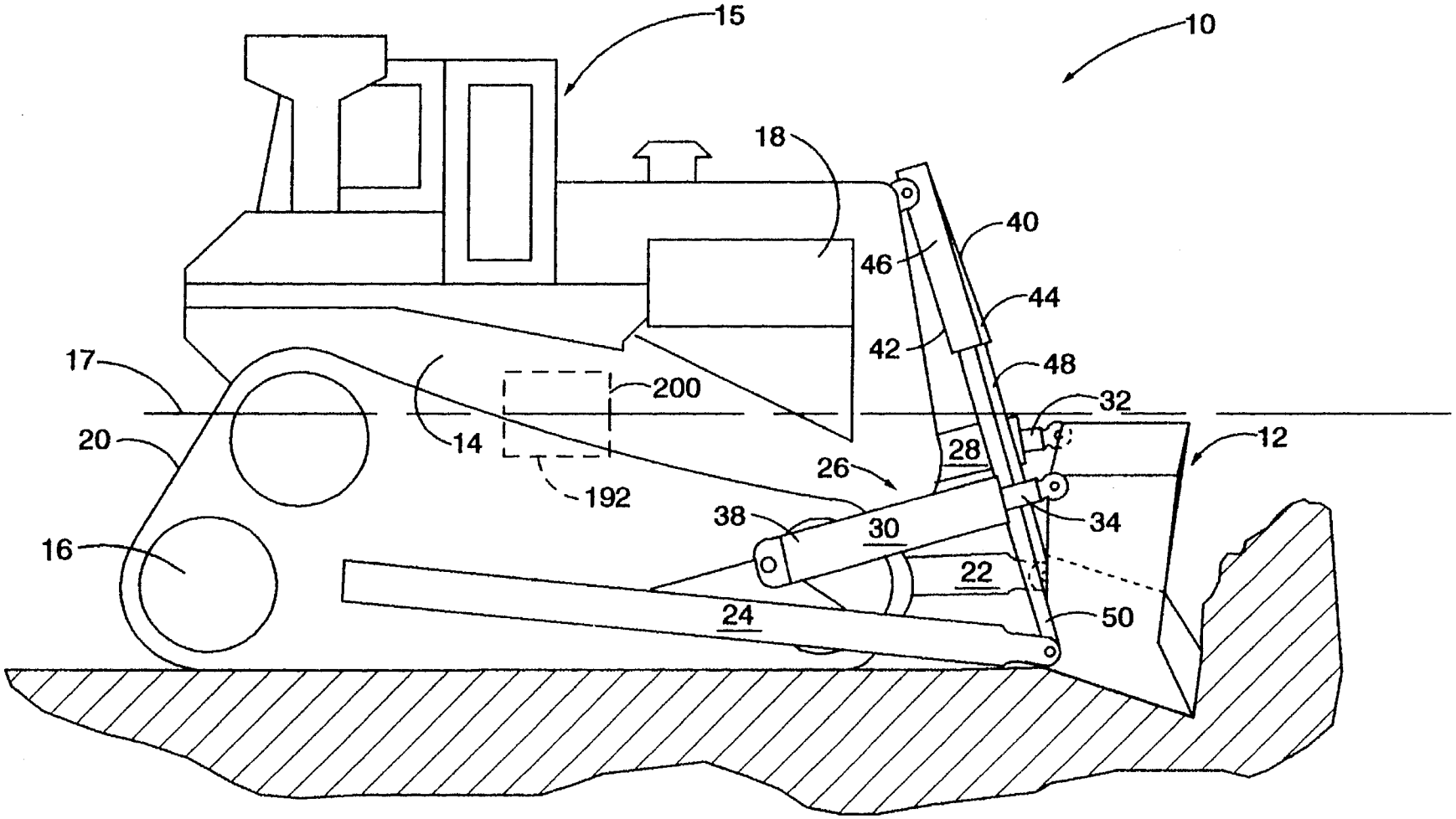
FIG. 1 is a diagrammatic side elevational view of an embodiment of the present invention showing geographic surface altering machine having an implement movably mounted thereon.

With reference to FIG. 1, a side elevational view of an embodiment of a geographic surface altering machine 10 having an implement 12 movably mounted thereon is disclosed. In the particular embodiment shown the geographic surface altering machine is a track type tractor and the implement is an elongate blade used for dozing. To simplify the explanation of the invention discussed herein will be limited to the specific embodiment shown, however, it is noted that other machinery having a movable geographic surface altering implement, for example, a motor grader, wheel loader, compactor, paver, asphalt layer, profiler, and the like are equivalents and within the scope of this invention.

The machine 10 has a frame 14, an undercarriage 16 connected to the frame 14, a prime mover 18 such as an internal combustion engine and a longitudinal centerline 17 passing preferably longitudinally through the center of gravity of the machine 10. The prime mover 18 is drivingly connected to an endless track 20 of the undercarriage 16, in any conventional well known manner. The prime mover rotates the track 20 and propels the machine 10 over the underlying terrain.

First and second spaced apart push arms 22,24, pivotally connected at opposite ends thereof to the implement 12 and the frame 14, respectively, in a conventional manner, such as by a pivot shaft, pivotally connects the implement 12 to the frame 14. The push arms hold the implement transverse a front end of the machine 10 as viewed from the operators station 15.

Figure 4:
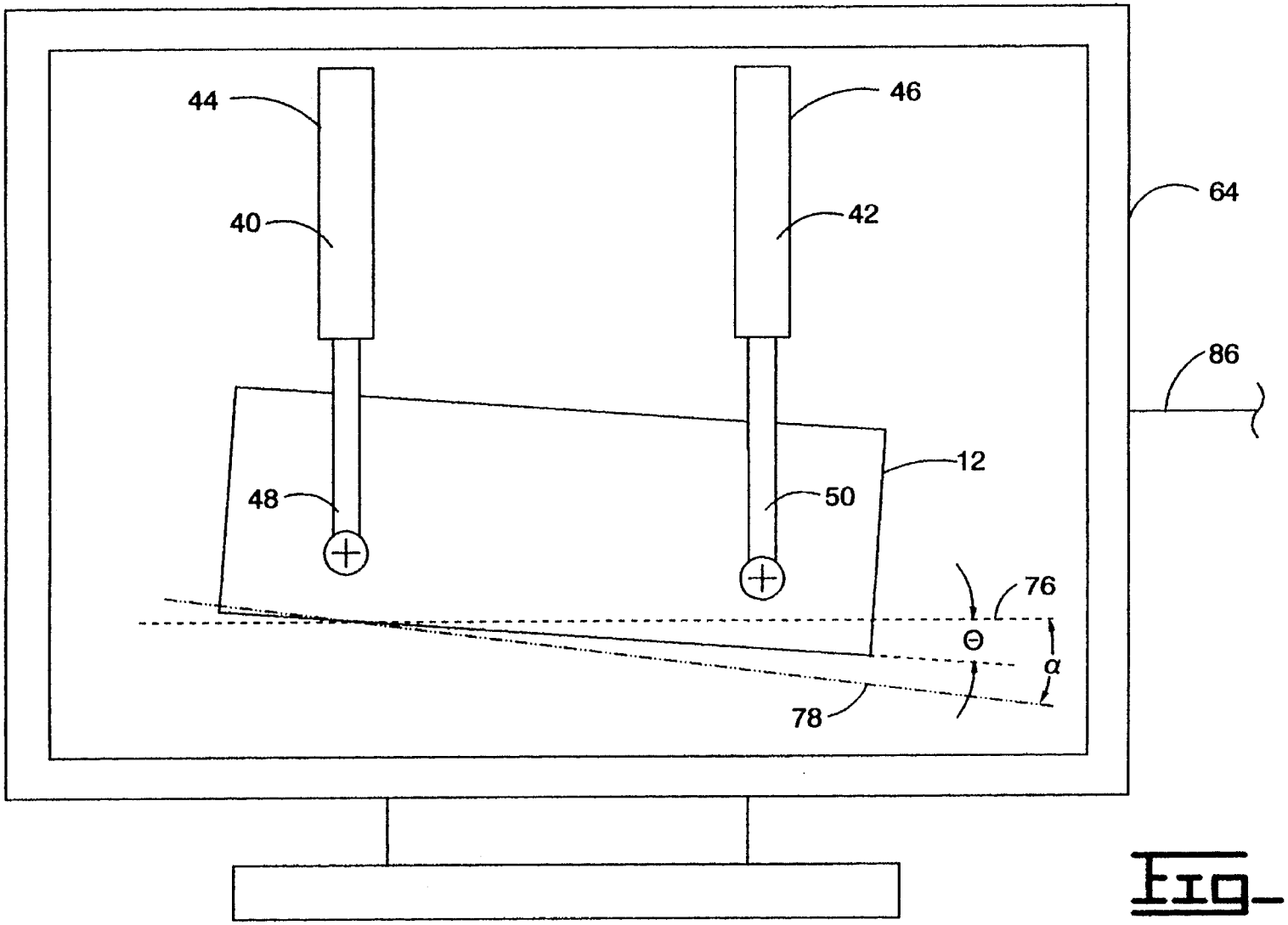
FIG. 4 is a enlarged diagrammatic front plan view of a monitor of FIG. 1 disclosing the angular position of the implement relative to a baseline and a desired position line.

A tilt jack means 26, including first and second spaced apart fluid operated extensible tilt jacks 28,30, preferably hydraulic cylinders but not limited thereto, is provided for tilting the implement 12 relative to the frame 14 in first and second directions from a base position. The base position is substantially a horizontal position of the a cutting edge of the implement 12 when the machine 10 is supported on a substantially flat horizontal surface. A rod end portion 32 of the first tilt jack 28 is pivotally connected to the implement 12, in a conventional manner, such as by a clevis and pivot pin. Similarly, a rod end portion 34 of the second tilt jack 30 is pivotally connected to the implement 12, in a conventional manner, such as by a clevis and pivot pin. A head end portion 36 of the first tilt jack 28 is pivotally connected to the first push arm 22 in a conventional manner, such as by a clevis and pivot pin. Similarly, a head end portion 38 of the second tilt jack 28 is pivotally connected to the second push arm 24 in a conventional manner, such as by a clevis and pivot pin. It is to be noted that the rod and head end connections can be reversed without departing from the spirit of the invention. Extension or retraction of the rod end portion 32,34 of either of the first and second tilt jacks 28,30 relative to the head end portion 36,38 will cause tilting of the implement 12. In this context, the slope of dozing is controlled by controlling the implement tilt angle $\gamma$ (FIG. 4). The implement tilt angle $\gamma$ as seen from the operators station 15 .appears as a relative lowering of either a right or left hand corner of the implement 12.

First and second spaced apart fluid operated lift jacks 40,42 are provided for elevationally moving the implement relative to the frame 14. The fluid operated lift jacks are preferably hydraulically operated fluid operated lift cylinders of well known construction. The first lift jack 42 has a first end portion 44 pivotally connected to the frame 14 and the second lift jack 42 has a first end portion 46 pivotally connected to the frame 14. The first lift jack 40 has a second end portion 48 which is pivotally connected to the implement 12 and the second lift jack 42 has a second end portion 50 which is pivotally connected to the implement 12. These pivotal connections to the frame 14 and the implement 12 are made in any suitable well known manner, for example such as by a pivot pin and clevis arrangement. The second end portions 48,50 are extensibly movable relative to the respective first end portions 44,46. Elevational movement of the implement 12 (about the pivotal connection of the first and second push arms 22,24) relative to the frame 14 and extensible movement of the lift jacks 40,42 occurs simultaneously. The lift jacks 40,42 are spaced a preselected distance "D" (FIG. 3) at the pivotal connection of the second end portions 48,50 to the implement 12.

Figure 2:
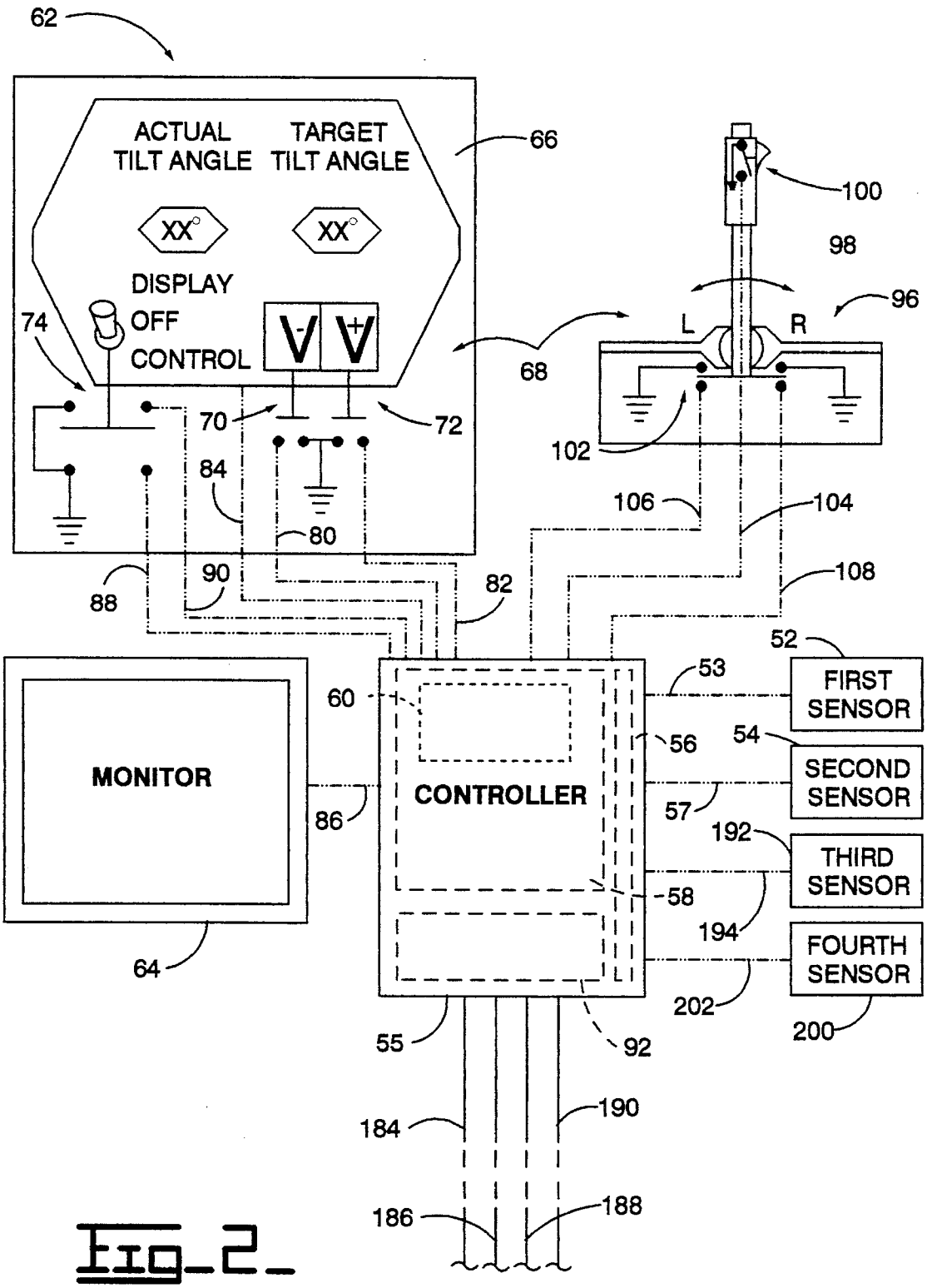
FIG. 2 is a diagrammatic schematic representation of an embodiment of the control system of the present invention.

Referring to FIG. 2, a first sensing means 52 is connected to the first lift jack 40. The first sensing means 52 is provided for sensing the position of the first lift jacks second end portion 48 relative to the first end portion 44 and delivering a responsive first position signal.

A second sensing means 54 is connected to the second lift jack 42. The second sensing means is provided for sensing the position of the second lift jacks second end portion 50 relative to the first end portion 46 and delivering a responsive second position signal.

The first and second sensing means 52,54 each preferably include a linear variable differential transformer (LVDT) of a type well known in the art. An LVDT is a magnetic position responsive device which generates a pulse width modulated (PWM) signal. In the particular application disclosed herein, the PWM signal generated by the first sensing means 52 is proportional to the relative positions of the first 44 and second 48 end portions of the first 40 lift jack, and the PWM signal generated by the second sensing means 54 is proportional to the relative positions of the first 46 and second 50 end portions of the second lift jack 42. It should be noted that other well known devices, for example, a yoyo type encoder, potentiometer, or resolver, and an RF signal generator are suitable replacements for the LVDT and within the scope of the invention.

The first and second sensing means 52,54 are connected to a control means 55 by lines 53 and 57, respectively. The control means 55 includes a converting means 56 having and integrator for converting a pulse width modulated signal to a voltage and a A/D converter for changing an analog signal to a representative digital signal. The delivered PWM signal is converted to a digital signal for the purpose of further processing.

The control means 55 includes a processor 58 of any appropriate type suitable for processing the first and second position signals in accordance with preprogrammed instructions and a memory 60 for storing instructions, information, and processed information. The control means 55 determines the magnitude of difference between the relative positions of the second end portion 48,50 of the first and second lift jacks 40,42, based on the first and second position signals, calculates a tilt angle value $\gamma$ (the tilt angle value of the implement relative to the frame 14).

Figure 3:
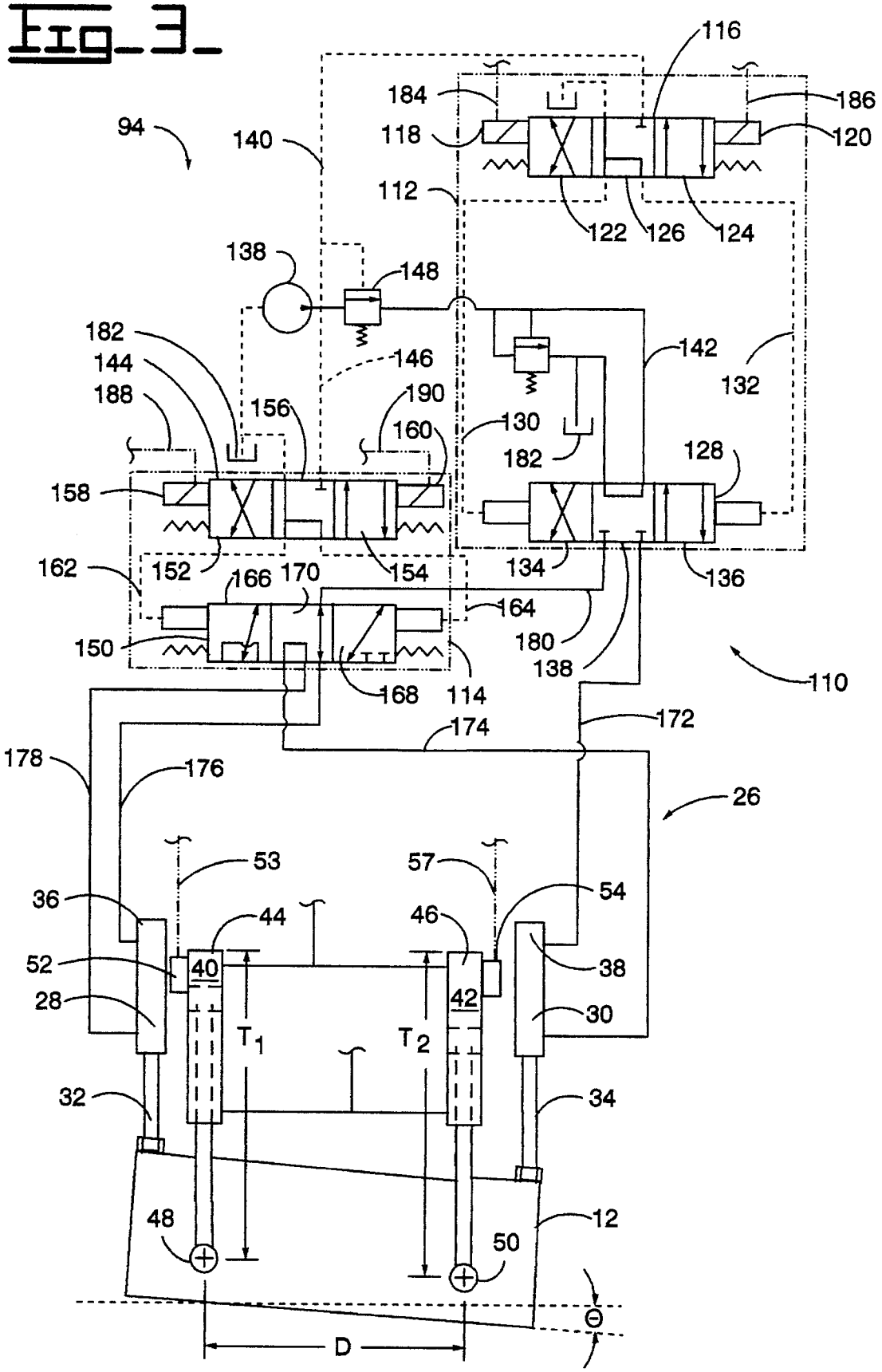
FIG. 3 is a diagrammatic schematic of a fluid operated system provided for positioning the implement.

The implement tilt angle $\gamma$ is computed as follows:

$\gamma$=Arctan $(T_1-T_2)/D$ where:

$T_1$=The magnitude of the distance between the first and second end portions 44,48 of the first lift jack 40 (FIG. 3).

$T_2$=The magnitude of the distance between the first and second end portions 46,50 of the second lift jack 42 (FIG. 3).

D=The distance between the second end portions 48,50 of the first and second lift jacks 40,42.

A third sensing means 192 is provided for sensing the initial frame tilt angle $\beta_0$ relative to a predetermined plane which is preferably horizontal, but not limited thereto, and for delivering a responsive frame tilt angle signal to the control means 55 by line 194. The third sensing means 192 preferably includes an inclinometer of any well known commercially available type. The inclinometer is mounted on the machine frame 14 at a location on the frame in close proximity to the centerline 17 and center of gravity of the machine 10. The inclinometer produces an analog signal which is converted to a digital signal for purposes of processing by the control means 55.

It is to be noted that the third sensing means 192 includes the use of a differential kinematic global position system of a type well known in the industry. Such a system utilizes at least one receiver on the vehicle and a processor for determining the machine coordinate position (x,y,z). The tilt angle of the frame 14 relative to a true vertical line (a line perpendicular to the horizontal plane) is easily determined from this information. This information is used to determine the frame tilt angle $\beta_0$ and during initialization of the frame tilt angle.

A fourth sensing means 200 is provided for sensing a rate of change of the frame tilt angle $\beta$ relative to the preselected plane and for delivering a responsive rate of change signal to the control means 55 by line 202. The fourth sensing means 200 preferably includes a tilt rate sensor of any commercially available type such as piezo electric dynamic sensor. The tilt rate sensor is mounted on the frame 14 at a location on the frame 14 in close proximity to the centerline 17 and center of gravity of the machine 10. The tilt rate sensor produces an analog signal which is converted to a digital signal in order to be processed by the control means 55.

The control means 55, and specifically the processor determines a corrected frame tilt angle $\beta$ in accordance with the following equation:

$\beta={}_0\int^t d\beta/dt+\beta_0$ where:

$\beta$=The corrected frame tilt angle.

$d\beta/dt$=The rate of change signal.

$\beta_0$=The frame tilt angle based on the frame tilt angle signal.

The control means 55, and specifically the processor 58, combines the corrected frame tilt angle $\beta$ and the calculated implement tilt angle $\gamma$ ($\theta=\beta+\gamma$) and delivers a responsive corrected implement tilt angle signal. Since the corrected tilt angle $\beta$ of the frame 10 relative to the predetermined plane is included in determining the corrected implement tilt angle, the tilted angle of the implement 12 relative to the predetermined plane is relatively accurate and provides the capability of producing a more accurate slope during machine 10 operation.

A display means 62, which is connected to the control means 55, receives the corrected implement tilt angle signal and indicates a corresponding corrected implement tilt angle $\theta$ relative to the predetermined plane as represented by a baseline position 76. Since the system is dynamic the displayed corrected implement tilt angle will change during tilting movement of the implement.

As shown in FIG. 2, the display means 62 includes a monitor 64 and an indicator 66. It is to be noted that either the monitor 64 or indicator 66 may be eliminated without departing from the spirit of the invention. The monitor 64 may be color or monochromatic and of any suitable commercially available construction. The monitor 64 displays a pictorial representation of the tilted implement 12 determined by the aforementioned calculations. The angle of the tilted implement is at the corrected implement tilt angle relative to the baseline 76. A target tilt line 78 showing the desired tilt angle $\alpha$ relative to the baseline 76 is also displayed. The baseline 76 and the target line 78 are represented respectively by different types of lines, for example, hidden and phantom lines.

The indicator 66 numerically displays the corrected implement tilt angle $\theta$ and a desired tilt angle $\alpha$, both relative to the baseline 76. The indicator 66 may include a rotary or a radial dial indicator, a light emitting diode indicator, and a liquid crystal display or a combination thereof.

A command means 68, connected to control means 55, is controllably actuatable to deliver a selected one of a plurality of implement tilt command signals to the control means 55. The command means 68, includes first and second button type selector switches 70,72. The direction of the desired tilt angle of the implement 12 is indicated by an illuminated one of commercially available left and right button type selector switches 70,72. The selector switches 70,72 enable the operator to select the magnitude of the desired tilt angle $\alpha$ and the direction of tilting of the implement 12. Selection is achieved by simply depressing one of the switch buttons 70,72 and maintaining the button depressed until the desired tilt angle $\alpha$ is displayed on the indicator 66. The target line 78 on the monitor 64 will, during selection of the desired tilt angle $\alpha$, indicate pictorially by an appropriate angled target line 78, the desired tilt angle $\alpha$ being numerically displayed on the indicator 66.

The left and right switches 70,72 are connected via lines 80 and 82 to the control means 55 and to ground. When depressed the switches connect the control means to ground and causes the control means 55 to deliver a signal via line 84 to the indicator 66 and line 86 to the monitor. Depending on which switch button is depressed, the current direction of tilting of the implement and the magnitude of the desired implement tilt angle $\alpha$ will increase or decrease. The direction of tilt from the baseline 76 will be illuminated on the appropriate one of the right or left selector switch buttons 70,72. The target tilt line 78 on the monitor 64 will reflect this angled position. The indicator 66 advances incrementally and displays the appropriate numerical value of the desired tilt angle α.

The command means 68 also includes a switch means 74, for example, a three position toggle switch, which is movable between "DISPLAY", "CONTROL" and "OFF" positions. At the CONTROL position line 88 is connected to ground and in the DISPLAY position line 90 is connected to ground. In the CONTROL position the control means 55 is conditioned to deliver an implement tilt control signal to a fluid operated implement control system 92. In the DISPLAY position the control means 55 is conditioned to deliver a signal to the display means 62 via lines 84 and 86 and display the corrected implement tilt angle θ, as determined by the above disclosed calculations, numerically on the indicator 66 and pictorially on the monitor 64. In the OFF position the DISPLAY and CONTROL modes of operation are inoperative. It is to be noted that in both the DISPLAY and CONTROL positions of switch means 74 the corrected implement tilt angle θ will be indicated in the manner described above.

At the CONTROL position of the switch means 74, the control means 55, based on preprogrammed instructions, automatically compares the desired tilt angle α (shown as the target tilt angle on the indicator 66) stored in memory 60, the magnitude and direction of which was selected by way of the right and left selector switches 72,74, to the corrected implement tilt angle α and delivers a responsive implement tilt control signal. The implement tilt control signal, based on this comparison, will command a driver circuit 92 of any suitable commercially available type, to effect actuation of a fluid operated system 94 and thereby move the implement 12 in the proper direction to the desired implement tilt angle α. The control means 55, in response to the desired and corrected implement tilt angle θ positions being substantially the same, will stop delivering the implement tilt control signal and cause the driver circuit 92 to stop actuation of the fluid operated system 94. It is to be noted that in the context of this invention stopping delivery of the implement tilt control signal is equivalent to and includes the act of delivering a stop control signal and positively effect cessation of actuation of the fluid operated system 94. Operation of the fluid operated system 94 will be subsequently discussed in greater detail.

The command means 68 includes a joystick controller 96 having a joystick 98 pivotally movable to a plurality of different positions. The joystick controller 96 is connected to the control means 55 and delivers a different tilt command signal at each of the different positions thereof. The joystick controller 96 is manually movable and includes a trigger switch 100 mounted on the joystick 98 for selecting first and second tilt modes of operation. In the second mode only one of the two tilt jacks 28,30 is actuatable between extended and retracted positions and in the first mode simultaneous operation of the two jacks 28,30, extension of one and retraction of the other is provided. A two position switch 102 is connected to the controller 96 and is responsive to pivotal movement of the joystick 98 for selecting the direction of tilting movement, lower ("L") or raise ("R"), of one side of the implement 12 in the second mode of operation, or left ("L") or right ("R") tilting of the implement 12 in the first mode of operation. A potentiometer or other suitable variable signal generating device (not shown) delivers a different signal at each different position of the joystick 98 to control the speed of implement movement. The trigger switch 100 is connected to deliver a tilt second mode select signal to the control means 55 by line 104 when depressed, and the two position switch is connected to deliver a "L" and "R" tilt signal to the control means 55 by lines 106 and 108, respectively. It is to be noted that the joystick controller 96 also controls the lift and tip (pitch) of the implement 12 in a conventional manner and will therefore not be further discussed.

It should be noted that the joystick controller 96 may be used to set the desired tilt angle and thereby replace the left and right selector switches 70,72 previously discussed. To achieve this, the operator would simply use the joystick 98 to manually place the implement at the desired tilt angle position. By way of a set switch (not shown), manually actuated by the operator, a set signal would be delivered to the control means 55. The control means in response to this signal would learn the position, the corrected implement tilt angle and store this angle in memory 60 as the desired tilt angle.

The control means 55 responds to the tilt command signals delivered from the joystick controller 96 and delivers a responsive tilt control signal to the fluid operated system 94. The fluid operated system 94 responds to thins signal and effects movement of the implement in a direction and at a speed selected by the joystick controller 96. Since the display 64 is responsive to angle calculations which are partially based on the signals delivered from the first and second sensing means 52 and 54, the corrected tilt angle of the implement 12 displayed by the display means 62 will change during manual operation by the joystick controller.

Referring to FIG. 3, the fluid operated control system 94 includes a valve means 110 for selectively directing pressurized fluid flow to said tilt jack means 26 and extending or retracting the rod end portion 32,34 of either or both of the first and second tilt jacks 28,30 in order to place the implement 12 at a desired tilted position. The valve means 110 includes, but is not limited to, first and second control valve means 112 and 114. The first control valve means 112 includes an electrohydraulic control valve 116 having first and second solenoid operated actuators 118,120 for shifting the control valve 116 between the first 122 and second 124 fluid directing positions from a spring biased neutral position 126. The first control valve means 112 includes a pilot operated control valve 128 connected to the electrohydraulic control valve 116 by conduits 130, 132 and shiftable between first 134 and second 136 positions from a spring biased neutral position 138 in response to pressurized fluid flow being delivered from valve 116 by conduits 130,132.

A pressurized fluid source such as a hydraulic pump 138 is connected to the electrohydraulic control valve 116 and the pilot operated control valve 128 via conduits 140, 142. The pressurized fluid source 138 is also connected to an electrohydraulic control valve 144 of second control valve means 114 by conduit 146. A pressure reducing valve 148 is provided to maintain the pilot pressure of the fluid delivered by conduits 140 and 146 at a predetermined value so that the pilot operated control valve 128 and a pilot operated selector valve 150 of the second control valve means 114 may be accurately controllably positioned by the respectively associated electrohydraulic control valves 116,144.

The electrohydraulic control valve 144 of the second control valve means 114 has first and second fluid directing positions 152,154 and a spring biased neutral position 156. First and second solenoids 158,160 are provided for shifting the valve 144 between the first and second fluid directing positions 152,154 from the neutral position 156. The second control valve means 112 includes a pilot operated selector valve 150 connected to the electrohydraulic control valve 144 by conduits 162, 164. The pilot operated selector valve 150 is shiftable between first 166 and second 168 positions, respectively, from a spring biased center position 170, in response to pressurized fluid flow being delivered from valve 144 by conduits 162 and 164, respectively. The head end portion 38 of the second tilt jack 30 is connected to a port of pilot operated control valve 128 via conduit 172 and the rod end portion 34 is connected to a port of the pilot operated selector valve 150 by conduit 174. The head end portion 36 of the first tilt jack 28 is connected to a port of the selector valve 150 by conduit 176 and the rod end portion 32 is connected to another port of the selector valve 150 by conduit 178. A port of each of the pilot operated selector and control valves 150, 128 are connected by conduit 180. The conduits mentioned above carry pressurized fluid flow between the tilt jack means 28 and the respective valves 128,150 in a conventional manner.

At the centered position 170 of the selector valve 150 the fluid operated system is conditioned to cause extension or retraction of one of the first and second jacks 40,42 and extension or retraction of the other of the first and second jacks opposite the one jack. The direction of extension and retraction is a function of the position of the pilot operated control valve 128. This results in rapid tilting movement of the blade in right or left directions as viewed from the operators station 15. By way of illustration, at the first position 136 of the first control valve 128, fluid flow from the pump 138 is directed to the head end 38 of the second tilt jack 30 by conduits 142 and 172 to extend the rod end portion 34. Fluid flow from the rod end portion 34 of the second tilt jack 30 is delivered to the rod end 32 of the first tilt jack 28 via conduits 174,176 and the selector valve 150. And, fluid flow from the head end 36 is delivered to a reservoir 182 via conduits 178,180 and the selector and control valves 150,128. Shifting of the control valve 128 to the first position 134 will reverse the direction of fluid flow.

At the second position 168 of the selector valve 150 fluid flow is deliverable to either the rod or head end portion of the second tilt jack only and the first tilt jack 28 is hydraulically locked at the selector valve 150. This provides tilting of the blade in either the left or right directions as observed from the operators station 15 and as shown in FIGS. 3 and 4.

At the first position 166 of the selector valve 150 the rod end 34 of the second tilt jack 30 is connected to the head end 236 of the first tilt jack 28 which provides tipping of the implement in a direction as determined by the position of the control valve 128. Tipping movement of the implement 12 is pivotal movement of the implement in a forward or rearward direction about the pivot connection of the implement 12 to the lift arms 22,24.

Referring to FIG. 2, lines 184 and 186 connect the control means 55 to solenoids 118 and 120, respectively, and lines 188 and 190 connect the control means 55 to solenoids 158 and 160, respectively. The lines deliver implement tilt control signals to the respectively connected solenoids and shift the electrohydraulic control valves to a desired position determined by the controller based on the implement tilt command signal delivered from the command means 68. The implement tilt command signal, as previously indicated, is a function of the joystick controller 96 in the manual mode of operation or the left and right selector switches 79,72 and the switch means 74 in the automatic mode of operation. In the automatic mode (switch 74 being at the control position) the compared corrected implement tilt angle $\theta$ with the desired tilt angle $\alpha$ determines which of the solenoids 118,120 is to be actuated and shift the valve 116 to achieve the desired direction of tilting movement of the implement 12 and to position the implement 12 at the desired implement tilt angle $\alpha$. For example, should the corrected implement angle $\theta$ be less than the desired implement tilt angle $\alpha$, a tilt control signal will be delivered to solenoid 120 which will shift the electrohydraulic control valve 116 to the second position 124. At this position the pilot fluid flow delivered by conduit 132 will shift pilot operated control valve 128 to the second position 136 which will deliver fluid flow via conduit 172 to extend the rod portion 34 until the implement 12 is at the desired implement tilt angle. When the desired implement tilt angle $\alpha$ and the corrected implement tilt angle $\theta$ are substantially equal, within a preselected tolerance, the processor 58 will make this comparison based on feedback from the first and second sensors 52,54 and the angle calculated in response thereto, the control means 55 will cease delivering a signal to the solenoid 120. As a result valve 116 will, under the centering spring bias, return to position 126 and thereby cause the pilot operated control valve 128 to return to position 138. At this position movement of the second tilt jack will cease and the implement 12 will be maintained at the desired implement tilt angle $\alpha$. This comparison is made whenever the switch means 68 is at the control position, the automatic made of operation.

It should be recognized that in the automatic mode of operation selector valve 150 is at the centered position 170. This however is only one of two possible options as presented. It should be recognized that the selector valve 150 may be at the second position 168 in the automatic control mode without departing from the spirit of the invention. An additional switch or the trigger switch 100 may provide selection between the two modes during the automatic control mode of operation.

Figure 5A:
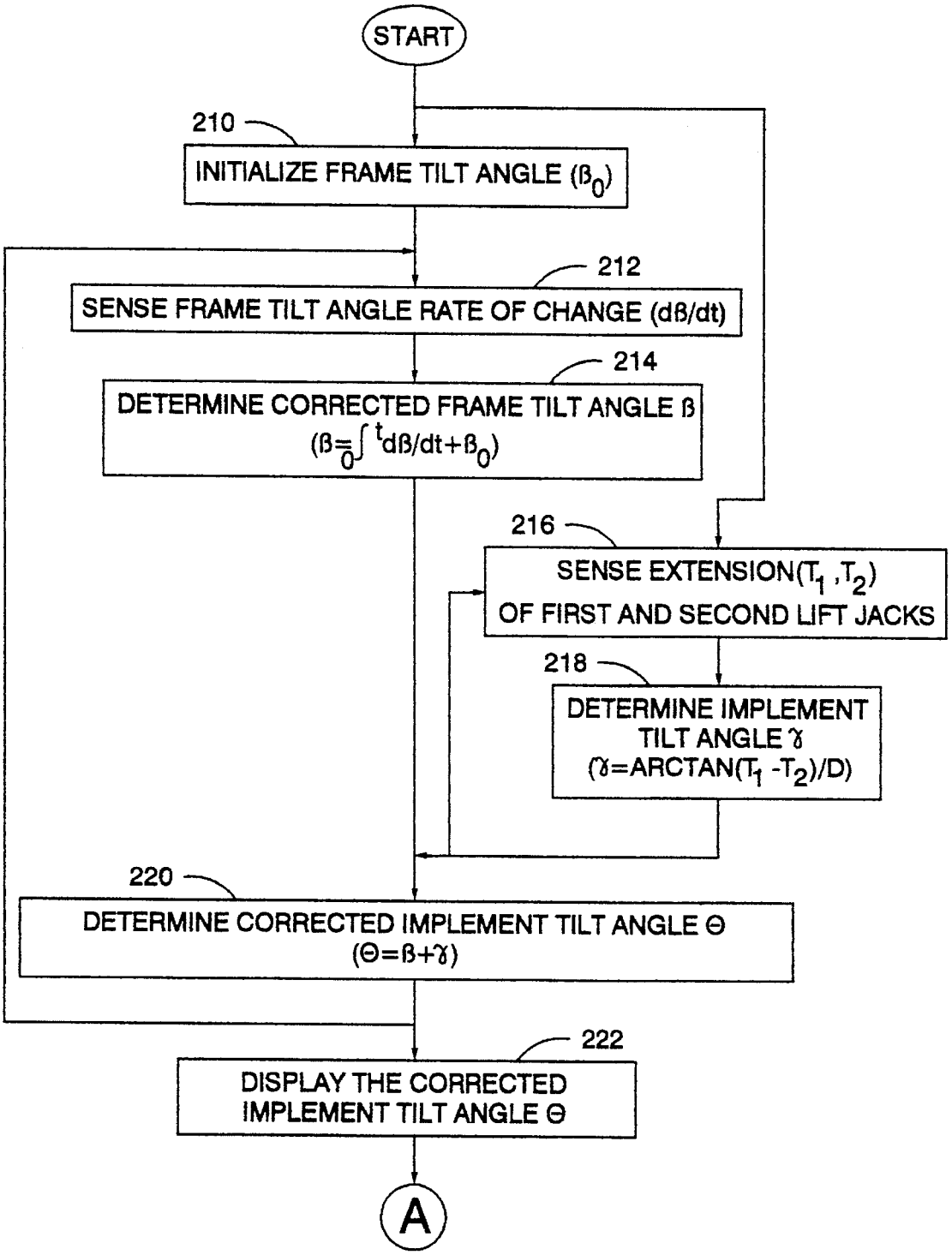
FIGS. 5A and 5B are flow charts of the steps associated with the method of determining, displaying, and correcting the implement tilt angle.
Figure 5B:
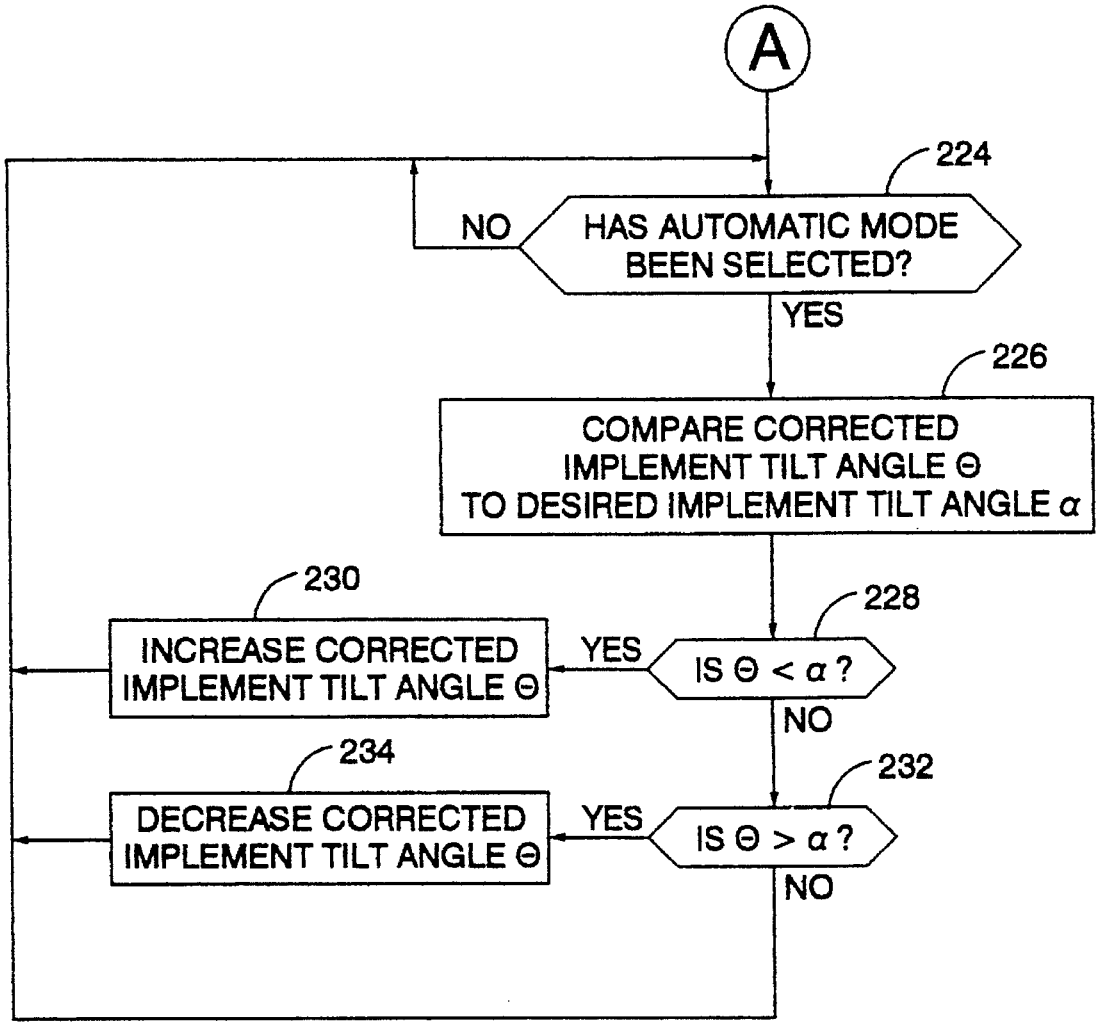

FIG. 5A is a flow chart illustrating a method of determining the corrected implement tilt angle and FIG. 5B is a flow chart disclosing the method of controlling the implement tilt angle. In FIG. 5A, box 210, the frame angle $\beta_0$ of machine 10 is initialized by placing the machine 10 on a substantially horizontal underlying surface and moving the switch 74 to either the DISPLAY or CONTROL positions. Since the machine is static during initialization, the tilt angle of the frame $\beta_0$, as sensed by the third sensing means 192, is delivered to the control means 55 by line 194, and stored in the processor 58. This frame tilt angle is the basis (predetermined plane or baseline) upon which subsequent calculations are based.

In box 212, the frame tilt angle rate of change sensed by the fourth sensing means 200 is delivered to the control means 55 for further processing. The rate of change of the frame tilt angle $\beta$ over time "t" ($d\beta/dt$) considers the dynamics of machine 10 operation. This information is used to compute the dynamic frame tilt angle by integrating the rate of change from 0 to predetermined time "t". A predetermined time "t" of one second for each series of calculations has been determined as adequate and within an acceptable range of time.

In box 214, the corrected frame tilt angle $\beta$ is processed in the control means 55 base on the equation $\beta={}_0\int^t d\beta/dt+\beta_0$, as discussed above. This equation sums the static initialized tilt frame angle $\beta_0$ and the dynamic tilt frame angle ${}_0\int^t d\beta/dt$. Thus, machine dynamics is accounted for in the processing.

During the processing of signals delivered from the third and fourth sensing means 192, 200, as discussed with respect to the sequence of boxes 210–214 above, processing of signals from the first and second sensing means 52,54 is simultaneously performed as indicated in the sequence of boxes 216,218. As indicated in box 216, the amount of extension "$T_1$" and "$T_2$" of the first and second lift jacks 40,42, respectively, is determined in the processor 58 based on the first and second position signals delivered to the control means 55. The processor 58 also determines the implement tilt angle $\gamma$, as set forth above and in box 218, based on the first and second signals and in accordance with the equation $\gamma$=Arctan $(T_1-T_2)/D$. This determination is repeated continuously and at a preselected frequency when in the CONTROL and DISPLAY modes of operations.

In the step of box 220, the corrected implement tilt angle $\theta$ is determined by combining the corrected implement frame angle $\beta$ with the implement tilt angle $\gamma$ as represented by the equation ($\theta=\beta+\gamma$). It is to be noted that both the implement and corrected frame tilt angles are determined on a continuous basis so that the accuracy of display and control are maintained at the highest level possible. The control means 55 delivers the corrected implement tilt angle signal to the display means 62, and as indicated in box 222, the corrected implement tilt angle $\theta$ is displayed.

The control logic, as set forth in the flow chart of FIG. 5B, relates to the automatic control mode of operation. The decision box 224 addresses the question, has the automatic mode of operation been selected. This is affirmed when the switch means 74 is at the CONTROL position. With the switch means 74 at the CONTROL position, the control means 55 compares the corrected implement tilt angle $\theta$ to the desired implement tilt angle $\alpha$, box 226. If the corrected implement tilt angle $\theta$ is less than the desired implement tilt angle $\alpha$, decision box 228, a signal is delivered from the control means 55 to increase the corrected implement tilt angle $\theta$, box 230. If the corrected implement tilt angle $\theta$ is greater than the desired implement tilt angle $\alpha$, box 232, the control means 55 delivers a signal to decrease the corrected implement tilt angle $\theta$.

It should be recognized that the processor 58 may utilize lookup tables, fuzzy logic and other suitable methods as substitutes for the above equations without departing from the spirit of the invention. However, one should recognize that the equations provide a basis for the logic involved in the implement tilt system.

Industrial Applicability

With reference to the drawings, and in operation, the operator may manually control tilting of the implement by way of the joystick controller 96 as discussed above or automatically control the tilt angle of the implement to a desired tilt angle by placing switch means 74 in the control mode position.

In the manual mode of operation the operator may observe the actual tilt angle of the implement 12 relative to the target tilt angle by referring to the monitor 64 and/or the indicator 66. Since this is a more accurate way of determining the actual tilt angle of the implement 12 relative to the target than visually observing the position of the actual implement, the speed at which the earth moving operation is performed may be increased and the number of passes may be reduced.

In the automatic (control) mode of operation the control system eliminates the guess work by the operator and automatically positions the implement 12 to the desired tilt position and maintains the implement 12 at the desired tilt position even under the dynamics of machine operation. It is to be emphasized that the high degree of accuracy provided in determining the corrected implement tilt angle by way of the above noted calculations based on the signals delivered by the first and second sensing means 52,54, provides a basis upon which control accuracy is achieved In addition, the third and fourth sensing means 192,200 enables the tilt control system to compensate for the dynamics of operation of the machine and thereby maintain the tilt angle of the implement 12 at the desired tilt angle relative to a baseline based on a predetermined plane.

In the method for determining a corrected tilt angle for the implement 12, the position of the first end portion 44 of the first lift jack 40 relative to the second end portion 48 of the first lift jack 40, the position of the first end portion 46 of the second lift jack 42 relative to a second end portion 50 of the second lift jack 42, the tilt angle of the frame $\beta_0$ relative to a predetermined plane and the rate of change $d\beta/dt$ of tilting of the frame 14 relative to the predetermined plane are all sensed. The implement tilt angle $\gamma$] based on the relative positions of the first and second end portions of the first and second lift jacks 40,42 is calculated, the corrected frame tilt angle $\beta$ based on the frame tilt angle $\beta_0$ and the rate of change of tilting of said frame 14, and the corrected implement tilt angle $\theta$ based on the implement tilt angle $\gamma$ and the corrected frame tilt angle $\beta$ are each calculated. The corrected frame tilt angle $\beta$ is calculated by integrating the frame angle rate of change $d\beta/dt$ from zero to a predetermined period of time.

The method further includes selecting a predetermined plane and determining the frame 14 position relative to the predetermined plane. The corrected implement tilt angle $\theta$ relative to said predetermined plane is displayed.

The method also includes selecting an automatic control mode of operation, comparing the corrected implement tilt angle $\theta$ to a desired implement tilt angle $\alpha$, and moving the implement 12 from the corrected implement tilt angle $\theta$ position toward the desired implement tilt angle $\alpha$ position. The corrected implement tilt angle $\theta$ is increased in response to the corrected implement being less than the desired implement tilt angle $\alpha$, and the corrected implement tilt angle $\theta$ is decreased in response to the corrected implement tilt angle $\theta$ being greater than the desired implement tilt angle $\alpha$.

Other aspects, objects and advantages of the present invention can be obtained from a study of the drawings, the disclosure, and the appended claims.

I claim:

1. A tilt angle control system for a geographic surface altering implement; comprising:

a frame;

first and second lift jacks each having first and second end portions and being connected at the first end portion to said frame and at the second end portion to an implement, said second end portions being extensibly movable relative to the first end portions in response to elevational movement of said implement;

first sensing means for sensing the position of the first end portion of the first lift jack relative to the second end portion of the first lift jack and delivering a responsive first position signal;

second sensing means for sensing the position of the first end portion of the second lift jack relative to the second end portion of the second lift jack and delivering a responsive second position signal;

third sensing means for sensing a tilt angle of the frame relative to a predetermined plane and delivering a responsive frame tilt angle signal;

fourth sensing means for sensing the rate of change of the frame tilt angle relative to the predetermined plane and delivering a responsive rate of change signal;

control means for receiving said first, second, frame tilt angle, and rate of change signals, determining an implement tilt angle relative to the frame based on the first and second signals, determining a frame tilt angle based on the frame tilt angle signal, determining a corrected frame tilt angle based on the frame tilt angle and rate of change signals, combining the implement tilt angle and the corrected frame tilt angle and delivering a responsive corrected actual implement tilt angle signal.

2. A tilt angle control system, as set forth in claim 1, including display means for receiving said corrected actual implement tilt angle signal and indicating a corrected actual implement tilt angle relative to the predetermined plane.

3. A tilt angle control system, as set forth in claim 2, wherein said display means includes a monitor connected to said control means, said monitor pictorially displaying the corrected actual implement tilt angle relative to a baseline representing the predetermined plane.

4. A tilt angle control system, as set forth in claim 2, wherein said display means includes an indicator connected to said control means and numerically displaying said corrected actual implement tilt angle relative to said predetermined plane.

5. A tilt angle control system, as set forth in claim 2, wherein said predetermined plane being a horizontal plane.

6. A tilt angle control system, as set forth in claim 1, wherein said control means including a processor having a memory, said processor calculating the corrected frame tilt angle in accordance with the following equation:

$$\beta={}_0\int^t d\beta/dt+\beta_0$$

where:

$\beta$=The corrected frame tilt angle.

$d\beta/dt$=The rate of change signal.

$\beta_0$=The frame tilt angle based on the frame tilt angle signal.

7. A tilt angle control system, as set forth in claim 6, wherein the control means determines the implement tilt angle in accordance with the following equation:

$$\gamma=\text{Arctan}\ (T_1-T_2)/D$$

where:

$\gamma$=The implement tilt angle.

$T_1$=The magnitude of the distance between the first and second end portions of the first lift jack.

$T_2$=The magnitude of the distance between the first and second end portions of the second lift jack.

D=The distance between the second end portions of the first and second lift jacks.

8. A tilt angle control system, as set forth in claim 7, wherein said corrected actual implement tilt angle is the sum of the corrected frame tilt angle and the implement tilt angle.

9. A tilt angle control system, as set forth in claim 2, including a command means for selecting an automatic control mode of operation, a display mode of operation, and a desired implement tilt angle, said control means comparing the corrected actual implement tilt angle to the desired implement tilt angle at the automatic control mode of operation and delivering an implement tilt control signal in response to said corrected actual implement tilt angle being greater or less than the desired implement tilt angle.

10. A tilt angle control system, as set forth in claim 9, including:

tilt jack means for tilting said implement in directions relative to said frame in response to receiving pressurized fluid flow, said tilt jack means being connected between said implement and frame;

a fluid operated implement control system connected to said control means and said tilt jack means, said fluid operated implement control system delivering pressurized fluid flow to said tilt jack means in response to receiving said implement tilt control signal, said tilt jack means moving said implement in a direction toward said desired implement tilt angle in response to receiving said pressurized fluid flow.

11. A tilt angle control system, as set forth in claim 10, wherein said tilt jack means includes a fluid operated tilt jack having a head end portion and a rod end portion, and wherein said fluid operated implement control system having a valve means for receiving said implement tilt control signal and directing pressurized fluid flow to a selected one of the head and rod ends of the fluid operated tilt jack, said valve means being connected to said control means and said fluid operated tilt jack.

12. A tilt angle control system, as set forth in claim 11, wherein said valve means includes an electrohydraulic control valve having first and second positions and being movable between said first and second positions, said valve means delivering pressurized fluid flow to one of the rod and head ends of the fluid operated tilt jack at the first position of the electrohydraulic control valve and to the other of the rod and head ends of the fluid operated tilt jack at the second position of the electrohydraulic control valve.

13. A tilt angle control system, as set forth in claim 9, wherein said third sensing means includes an inclinometer mounted on said frame at a preselected location relative to a longitudinal centerline of the frame, said fourth sensing means includes tilt rate sensor mounted on said frame at a preselected location relative to the longitudinal centerline of the frame, said inclinometer and tilt rate sensor sensing tilting movement of the frame about said longitudinal centerline, said inclinometer and tilt rate sensor being connected to said control means.

14. A tilt angle control system, as set forth in claim 9 wherein said control means includes a processor having a memory.

15. A method for determining a corrected tilt angle of an implement pivotally connected to a frame and first and second, spaced apart lift jacks, said lift jacks being connected to the frame; comprising the steps of:

sensing a position of a first end portion of the first lift jack relative to a second end portion of the first lift jack;

sensing a position of a first end portion of the second lift jack relative to a second end portion of the second lift jack;

sensing a tilt angle of the frame relative to a predetermined plane;

sensing a rate of change of tilting of said frame relative to said predetermined plane;

calculating an implement tilt angle based on the relative positions of the first and second end portions of the first and second lift jacks;

calculating a corrected frame tilt angle based on the frame tilt angle and the rate of change of tilting of said frame; and calculating a corrected implement tilt angle based on the implement tilt angle and the corrected frame tilt angle.

16. A method, as set, forth in claim 15, including the steps of:

selecting said predetermined plane; and initializing said frame position relative to said predetermined plane.

17. A method, as set forth, in claim 15, including the step of displaying said corrected implement tilt angle relative to said predetermined plane.

18. A method, as set forth in claim 15, including the steps of:

selecting an automatic control mode of operation;

comparing the corrected implement tilt angle to a desired implement tilt angle;

moving the implement from the corrected implement tilt angle toward the desired implement tilt angle.

19. A method, as set forth in claim 18, wherein the step of moving the implement from the corrected implement tilt angle toward the desired implement includes the steps of:

increasing the corrected implement tilt angle in response to the corrected implement being less than the desired implement tilt angle; and decreasing the corrected implement tilt angle in response to the corrected implement tilt angle being greater than the desired implement tilt angle.

20. A method, as set forth in claim 16, wherein said step of calculating a corrected frame tilt angle includes the step of integrating the frame tilt angle rate of change from zero to a predetermined period of time.

* * * * *

UNITED STATES PATENT AND TRADEMARK OFFICE
CERTIFICATE OF CORRECTION

PATENT NO. : 5,551,518

DATED : September 3, 1996

INVENTOR(S) : Kenneth L. Stratton

It is certified that error appears in the above-identified patent and that said Letters Patent is hereby corrected as shown below:

Column 4, line 7, delete "28" and insert --30--.

Column 4, line 20, after "jacks" insert --40,42--.

Column 5, line 13, delete "portion" and insert --portions--.

Column 7, line 28, delete "72,74" and insert --70,72--.

Column 8, line 66, delete "112" and insert --114--.

Column 9, line 39, after "jack" insert --30--.

Column 9, line 62, delete "79" and insert --70--.

Column 10, line 24, delete "68" and insert --74--.

On the title page, item [22], delete "Dec. 19, 1994" and insert -- Sept. 28, 1994 --

Signed and Sealed this

Fourth Day of March, 1997

*Attest:*

*Attesting Officer*

BRUCE LEHMAN

*Commissioner of Patents and Trademarks*